United States Patent [19]

Coleman et al.

[11] 3,997,931

[45] Dec. 21, 1976

[54] PAD BOX FOR ACCOMMODATING DIFFERENT SHOE BOTTOMS

[75] Inventors: Trevor Norman Coleman, Oadby; Dennis Edward Skinner; Kenneth Charles Joseph Webster, both of Leicester, all of England

[73] Assignee: USM Corporation, Boston, Mass.

[22] Filed: Feb. 25, 1976

[21] Appl. No.: 661,358

[30] Foreign Application Priority Data

Aug. 15, 1975 United Kingdom ..... 34131/75

[52] U.S. Cl. ..... 12/38; 12/16.4

[51] Int. Cl.[2] ..... A43D 89/00; A43D 63/00

[58] Field of Search ..... 12/38, 33, 33.6, 16.1, 12/16.2, 16.3, 16.4

[56] References Cited

UNITED STATES PATENTS

| | | | |
|---|---|---|---|
| 2,985,901 | 5/1961 | Actis | 12/38 |
| 3,090,056 | 5/1963 | Lorenz | 12/38 |
| 3,092,860 | 6/1963 | Haas | 12/38 |

FOREIGN PATENTS OR APPLICATIONS

| | | | |
|---|---|---|---|
| 960,811 | 5/1972 | Italy | 12/38 |

*Primary Examiner*—Patrick D. Lawson

*Attorney, Agent, or Firm*—Carl E. Johnson; Richard B. Megley; Vincent A. White

[57] ABSTRACT

A pad box for cement attaching soles to differently shaped shoe bottoms comprises a forepart pad tiltably and vertically adjustable, a datum pad for supporting a shoe adjacent to its heel breast line, independent movable waist pads adjustable heightwise of the datum pad, a heel presser member mounted for movement heightwise and lengthwise of the shoe, and fluid pressure means for respectively operating the heel presser member and each of the waist pads. The arrangement and construction are such that the waist pads are fluid pressure actuated automatically to support the shoe bottom during pressing in accommodation of its lengthwise and widthwise configuration. Method aspects of the invention are also disclosed.

7 Claims, 3 Drawing Figures

PAD BOX FOR ACCOMMODATING DIFFERENT SHOE BOTTOMS

BACKGROUND OF THE INVENTION

The present invention is concerned with improvements in or relating to sole attaching, in particular the attachment of a sole to the bottom of a shoe by means of adhesive composition. The word "shoe" is used herein generically to include outer footwear generally whether complete or in the course of manufacture, and the word sole is used herein to include sole and heel units formed in one piece or assembled prior to attachment to shoes.

It is a well-known operation in the manufacture of shoes having a sole attached by means of adhesive composition to apply pressure thereto after the sole has been positioned on the bottom of the shoe in order to effect a firm bond. Shoes differ widely in shape and style and it is desirable in the sole attaching operation that a relatively big change from one shoe bottom shape to another can be quickly accommodated.

Machines for applying bonding pressure to shoes in order to adhesively bond the sole to the shoe bottom have comprised a shoe bottom pressing arrangement on which the shoe is supported, and depending presser members against which the shoe may be held by means by hydraulic pressure urging the shoe bottom pressing arrangement towards the depending presser members. Due to the considerable variety of shapes and sizes of shoes to be operated on, it has been a usual practice to provide interchangeable shoe bottom pressing arrangements for machines of this kind. Frequent changes of the arrangements may thus be needed during normal shoe factory production conditions, requiring either replacing the arrangement with another more suitable one, or detailed interchange of elements of the arrangement, thus potentially resulting in loss of production time and in inaccurate setting of the arrangement to the requirements for a given shoe. The wide variety of lengthwise and transverse curvatures encountered especially in the waists of shoes accentuates this problem.

SUMMARY OF THE INVENTION

It is one object of this invention to provide an improved shoe bottom pressing arrangement.

In order to reduce or render less onerous the amount of adjustment required of an operator, it is desirable to provide a shoe bottom pressing arrangement with a datum applicable for all shapes and sizes of shoes to be operated upon. Further, for convenience of manufacture and use of a shoe bottom pressing arrangement we believe this datum should preferably refer to the heel breast line.

Furthermore, it is generally desirable to ensure that adjustment means of a shoe bottom pressing arrangement are provided in as simple a form for ease and convenience of selection by an operator of the machine.

It is important, whatever the shape of shoe bottom operated on, that required pressure can be applied readily to various regions of the shoe, so that, for example, excessive pressure does not have to be exerted on forepart and/or heel regions in order to obtain adequate pressure in the waist region up to the heel breast line. It is important, too, that the required pressure be applicable to edge portions of the shoe bottom, and to this end that in the waist region especially the sole be wrapped firmly round widthwise curvature of the shoe bottom.

Because of the differences of toe spring appertaining to different shoe styles, it is desirable that the forepart supporting means should be adjustable relative to the waist supporting means. Some molded soles require pressure to be applied on the tread face of an integral heel; it may be desirable that the pressure applied on said tread face can readily be varied so as to avoid squabbing or rocking of the heel. Since heels vary in height it is desirable that difference in heel height are catered for automatically. Some heels, for example Louis heels, do not require pressure on the tread face but require supporting at the back to hold them against heelward movement when pressure is applied on the shoe bottom. It is desirable that a rapid change from tread face pressure to back pressure can be achieved.

With a view to providing a shoe bottom pressing arrangement, suitable for use in attaching a sole to the bottom of a shoe by means of adhesive composition, having improved versatility, there is hereinafter described a shoe bottom pressing arrangement, illustrative of apparatus aspects of the invention, comprising first means for supporting a waist portion of a shoe bottom, second means for supporting a forepart portion of a shoe bottom, and third means for supporting a heel portion of a shoe bottom. The first means of the illustrative apparatus comprises locating means for locating and applying pressure to a shoe in its heel breast line region, which locating means comprises an interchangeable pad mounted on a fixed bar of the arrangement. The fixed bar provides a fixed datum and is shaped so that even a shoe having a relatively high heel can be tilted heelwardly about the bar in positioning the shoe to give its best position for pressure distribution.

The mentioned second means of the illustrative apparatus hereinafter described comprises forepart supporting means comprising a pad for applying pressure to the forepart of a shoe, manually adjustable means for linearly adjusting the forepart supporting means relatively to the locating means in directions heightwise of the shoe to locate the pad in a selected one of a predetermined series of positions and manually adjustable means for adjusting the forepart supporting means relative to the locating means about an axis extending widthwise of the shoe so as to accommodate the shoe toe spring and be able to support the shoe in tilted position about the locating means if desirable in achieving better pressure distribution.

The mentioned first means of the illustrative apparatus includes a plurality of spaced apart presser members comprising waist pads between the locating means and forepart supporting means, each of the presser members having a fluid pressure operated device comprising a pair of air pressure operated pistons for moving it to apply pressure on the shoe bottom. Each waist pad is mounted so as to be tiltable under the influence of its pistons to accommodate widthwise contours of the shoe bottom. The waist pads are constructed and arranged so that under pressure they may deform into the spaces between them to present a more continuous pressure applying surface.

The referred to third means of the illustrative apparatus hereinafter described comprises a heel supporting element in the form of a heel presser member for applying pressure on the tread face of a heel, there being a fluid pressure operated arrangement comprising four air pressure operated pistons for moving the heel presser member to apply pressure on the heel. Thus variations in heel height are automatically catered for. The heel presser member is mounted on a freely pivoted support automatically to accommodate lengthwise and widthwise slope of the tread face of a heel of a shoe operated on by the apparatus. The heel presser member is readily detachable for replacement by another presser member suitable for applying pressure to the heel part of a shoe operated on without a heel. The fluid pressure operated arrangement for the heel presser member is connected with a fluid pressure supply separately from the fluid pressure operated devices for the waist pads and the pressure applied to a heel may be separately controlled.

The heel presser member is mounted for movement by said fluid pressure operated arrangement in a direction which is upwardly and heelwardly of the shoe being operated on thus to be able to operate on the tread face of a heel of a shoe tilted to a position in which the tread face end of the heel is excessively toewardly.

The third means of the illustrative apparatus also includes a fluid pressure operated heel back clamping device including a heel engaging element, mounted for movement to an out-of-the-way position when it is desired to use said heel presser member. The heel back clamping device comprises an air pressure operated piston and the illustrative apparatus comprises an air pressure circuit including a valve which is operated automatically when the heel back clamping device is moved to its out-of-the-way position so as to disconnect the last-mentioned air pressure operated piston with a source of pressure fluid and connect this source with the fluid pressure operated arrangement associated with the heel presser member. Thus, with the illustrative apparatus, a rapid change from available tread face pressure to available back pressure is achieved when the heel back clamping device is moved into position to be able to operate on the back of a heel.

A method is hereinafter described which is illustrative of method aspects of the invention, of using the illustrative apparatus in conjunction with a sole attaching press. The illustrative method comprises positioning a shoe with a sole positioned thereon and a layer of adhesive between the shoe bottom and the sole in the apparatus which is adjusted to the shape and style of the shoe in accordance with requirements above-mentioned, raising the apparatus by means of hydraulic pressure to engage the top of a toe portion of the shoe and a heel end part of a top of a last in the shoe with suitably positioned abutments so that the shoe is brought to rest under relatively light pressure against the abutments, then causing operation of the air pressure operated pistons to operate the waist pads and an increase in the hydraulic pressure to the maximum required to achieve a firm bond. By using air operated means yieldably to operate the waist pads, the air can be compressed to some extent and reduce the likelihood of the waist pads affecting the hydraulic pressure applied.

The invention provides, in accordance with one of it several features, apparatus suitable for use in attaching a sole to the bottom of a shoe by means of adhesive composition which apparatus comprises locating means for locating and applying pressure to the shoe, with its sole thereon, in its heel breast line region, forepart supporting means for applying pressure to the forepart of the shoe and which is adjustable relatively to the locating means in a direction heightwise of the locating means and relatively to the locating means about an axis extending widthwise of the shoe, a plurality of presser members between the locating means and the forepart supporting means, each of said members having a fluid pressure operated device for moving it to apply pressure to the shoe bottom, a heel presser member mounted for movement linearly in a direction which is heightwise and lengthwise of the shoe, and a fluid pressure operated arrangement for so moving the heel presser member.

The invention further provides, in accordance with another of its several features, apparatus suitable for use in attaching a sole to the bottom of a shoe by means of adhesive composition which apparatus comprises locating means for locating and applying pressure to the shoe, with its sole thereon, in its heel breast line region, forepart supporting means for applying pressure to the forepart of the shoe and which is adjustable relatively to the locating means in a direction heightwise of the locating means and relatively to the locating means about an axis extending widthwise of the shoe, a plurality of presser members between the locating means and the forepart supporting means, each of said members having a fluid pressure operated device for moving it to apply pressure to the shoe bottom, a heel presser member mounted for movement in a direction heightwise of the shoe, a fluid pressure operated arrangement for so moving the heel presser member, a fluid pressure operated back clamping device mounted for movement to an out-of-the-way position and means for automatically disconnecting said clamping device with a source of pressure fluid when it is moved to said position and connecting said source with the fluid pressure operated arrangement associated with the heel presser member.

The invention further provides, in accordance with another of its several features, a shoe bottom pad box or pressing arrangement comprising first means for supporting a waist portion of a shoe bottom and second means for supporting a forepart of a shoe bottom, the first means comprising a datum pad extending generally widthwise of the arrangement and a plurality of waist pads mounted for movement heightwise of the datum pad by pressure fluid and independently tiltable widthwise of the arrangement, the construction and arrangement being such that in a shoe bottom pressing operation the waist pads are actuated automatically to support the shoe bottom in accordance with its lengthwise configuration and may tilt widthwise to accommodate the widthwise configuration of the shoe bottom.

The invention further provides, in accordance with another of its several features, a method of attaching a sole to the bottom of a shoe by means of adhesive composition comprising locating the shoe with a sole positioned thereon and a layer of adhesive between the shoe bottom and the sole on locating means for locating and applying pressure to the shoe in its heel breast line region and on forepart supporting means for applying pressure to the forepart of the shoe, the forepart supporting means being adjustable relative to the locating means so that the shoe can be tilted lengthwise thereof about the locating means to position it according to the shape of the shoe bottom for the distribution of pressure along the shoe bottom, pressing the shoe so positioned and supported between said locating and supporting means and abutment means acting downwards on the shoe and a last therein under pressure from first fluid pressure means, moving a plurality of presser members between the locating means and the forepart supporting means under pressure from second fluid pressure means to apply pressure to the shoe bottom, and exerting sufficient pressure by the first fluid pressure means to secure the sole to the shoe bottom.

BRIEF DESCRIPTION OF THE DRAWINGS

The above and other of the several features of the invention will become clearer from a detailed description of the illustrative apparatus and illustrative method now to be given with reference to the accompanying drawings. The illustrative apparatus and the illustrative method are selected for description by way of exemplification of the invention and not by way of limitation thereof.

In the drawings.

Figure 1:
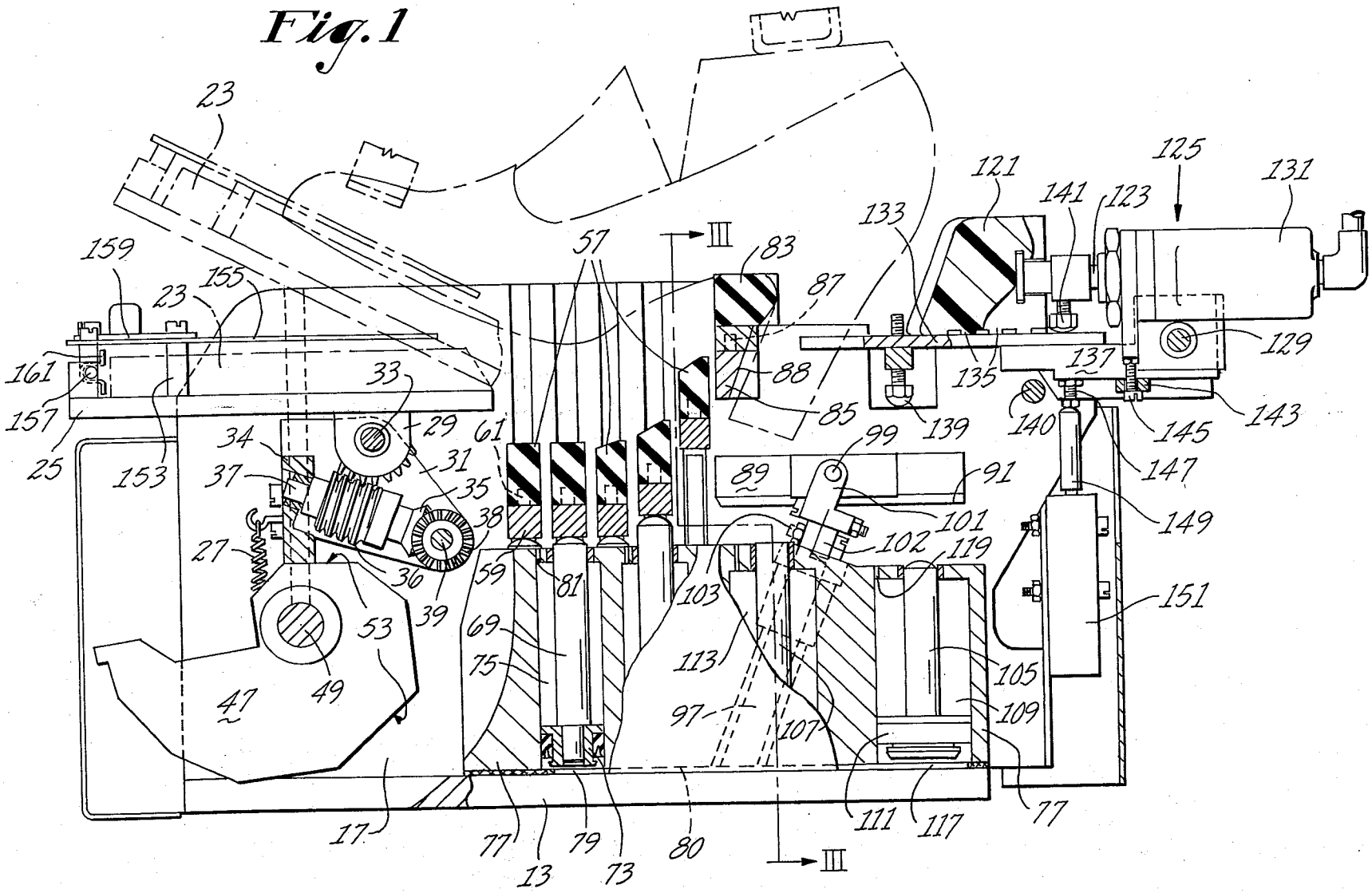
FIG. 1 is a front view, partly in section and with parts removed for the sake of clarity, of the illustrative apparatus and showing in phantom lines a shoe and forepart supporting means therefor as they may be positioned in the apparatus for operation on the shoe.

The illustrative apparatus comprises a shoe bottom pressing arrangement having a pad box base 13 (FIG. 3) having a front side wall 15 (FIG. 2) and a rear side wall 17. The apparatus includes shoe forepart supporting means for applying pressure to the forepart of a shoe comprising a shaped pad 23 removably supported on a forepart plate 25 (FIG. 1) by means of studs fixed in the plate.

The forepart plate 25 is pivotally mounted for adjustment to accommodate lengthwise spring of the forepart of the shoe positioned for operation thereon in the apparatus. Fixed to the bottom of the plate 25 is a toothed member 29 (FIGS. 1, 2) having teeth 31 extending round a portion of the member 29 and radially spaced from the axis of a pin 33 on which the member 29 is received. Opposite end portions of the pin 33 are supported in a carrier 34. A wormwheel 36 meshes with the teeth 31. The worm-wheel 36 is fixed on a shaft 37 mounted at a toeward end portion for rotation in the carrier 34. A bevel gear 35 fixed on a heelward end portion of the shaft 37 meshes with a bevel gear 38 fixed on a rear end portion of a shaft 39. The shaft 39 is rotatably mounted in an ear of the carrier 34, extends forwardly through a slot 40 (FIG. 2) in the side wall 15 and has a hand control knob 41 (FIG. 2) fixed on its foreward end. Rotation of the shaft 39 by means of the knob 41 rotates the worm-wheel 36 which moves the toothed member 29 about the axis of the pin 33 and adjusts the tilt of the plate 25 and rubber pad 23.

The pad 23 is mounted for vertical heightwise adjustment to accommodate shoes of different bottom shapes. For this purpose the carrier 34 is adjustable heightwise between the walls 15 and 17. Portions of the carrier 34 are slidingly received in vertical guideways 43, 45 (FIG. 2) respectively in the walls 15 and 17. The carrier 34 is held in engagement with selected edge faces of spaced apart similar snail cams 47, 47 (FIGS. 1, 2) by means of tension springs 27, 27 anchored between the carrier and base 13. The snail cams are fixed in spaced apart and aligned relationship on a shaft 49 supported for rotation in the walls 15 and 17. Rotation of the shaft 49 by means of a hand control knob 51 fixed on a portion of the shaft 49 extending through the wall 15 moves the snail cams 47 about the axis of the shaft to effect raising or lowering of the carrier 34 according to the direction in which the snail cams are adjustably rotated. The snail cams have a plurality of surfaces 53 spaced at different distances from the axis of the shaft 49, and said surfaces on which the carrier 34 rests are selected according to the predetermined heightwise position of the pad 23 required. A calibrated dial 55 (FIG. 2) is mounted for rotation with the shaft 49 to enable an operator readily to set the heightwise position of the pad 23 according to the shape of the shoe bottom to be operated on.

The illustrative apparatus comprises shoe waist supporting and pressing parts preferably comprising five waist pads 57 supported in spaced apart relationship lengthwise of a shoe positioned in the pad box. Each waist pad is removably supported on a support bar 59 by means of two studs 61 in each bar. Each bar 59 is slidingly received in vertical guideways 63, 67 (FIG. 2) formed respectively in the walls 15 and 17 so that the bars extend in parallel relationship widthwise of a shoe position in the apparatus. Each bar rests on domed upper ends of two spaced apart piston rods, there being five piston rods 69 (one for each bar) nearer to the wall 15 and five piston rods 71 (one for each bar) nearer to the wall 17. Each piston rod 69, 71 has a piston 73 fixed to its lower end and slidingly received in a cylinder 75. Accordingly there are ten cylinders 75 which are formed in a cylinder block 77 fixed to the base 13 between the walls 15 and 17. The cylinders extend parallel to the guideways 63, 67 and the waist pads 57 are raised to apply pressure to the bottom of a shoe, positioned in the apparatus, by the introduction of air under pressure beneath the pistons 73 thus to move them up their respective cylinders and raise their respective piston rods 60, 71. Under pressure on the bottom of the shoe the pads 57 tend to deform and fill the spaces between said pads.

Figure 3:
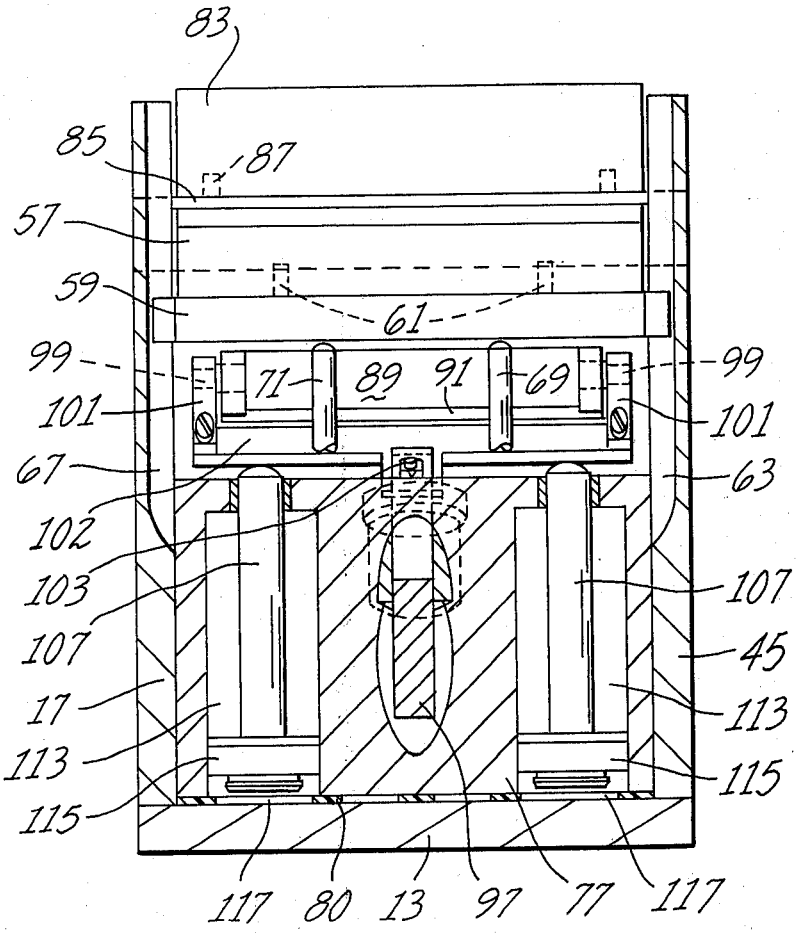
FIG. 3 is a broken section taken on the line III—III in FIG. 1.

The lower end of each cylinder 75 is open and communicates with a recess 79 formed by a cut-out portion of a gasket 80 (FIG. 3) clamped between the base 13 and cylinder block 77. The illustrative apparatus has means for connecting the recess 79 with a factory air line, and air under pressure introduced into the recess enters the ten cylinders to raise the pistons 73. The piston rods 69 and 71 are supported slidingly at upper ends of the cylinders. There is a bleed passage 81 (FIG. 1) at the upper end of each cylinder to allow the escape of air above its associated piston when the piston is raised. In their rest positions the waist pads 57 take up positions shown in FIG. 1 conforming generally to shoe bottom inclination in the waist region. The piston rods 69, 71 for raising the most heelward of the pads 57 are of reduced diameter to provide clearance for shoe heel pressing parts hereinafter described. Referring particularly to FIG. 3, it will be appreciated that the support bars 59 for the waist pads 57 can tilt in the guideway 63 and 67 and accommodate widthwise tilt of a shoe bottom under the influence of equalizing pressure exerted by the spaced apart piston rods 69 and 71 supporting each bar. Upper surfaces of the pads 57 are shaped to accommodate widthwise curvature of shoe bottoms. The shaping of the pads 57 and their tiltability help to wrap the sole around a shoe bottom and ensure firm bonding at the edges.

The illustrative apparatus comprises means for locating a shoe placed therein in the region of its heel breast line. Said means comprises a pad 83 (FIGS. 1–3) removably supported on a bar 85 by means of two studs 87 spaced apart on the bar 85. The bar 85 extends horizontally between the walls 15 and 17 and is fixed thereto. A pad 83 shaped appropriately for the shoe to be operated on may be supported on the bar 85, e.g. a pad having a sharp corner at its top heelward end may be used for attaching a sole having a heel which forms a square heel breast corner and a different block appropriately curved may be used for attaching a sole having a Louis heel attached. In order to obtain a better equalization of pressure applied to the bottoms of some shoes having exaggerated waist curvature it may be desirable to tilt up the forepart and tilt down the heelpart. To accommodate a tilted heel the pad 83 may be appropriately shaped on its heelward surface and to receive the heel a clearance 88 (FIG. 1) is formed in the bar 85.

The illustrative apparatus comprises shoe heel supporting parts suitable when required for applying pressure to the tread face end of a heel of a shoe positoned in the apparatus. The heel pressing parts comprise a pad 89 (FIGS. 1, 3) removably supported on a plate 91 by means of studs fixed in the plate. The plate 91 is pivotally mounted on an upper end portion of a plunger having a downwardly extending stem portion 97 of square cross-section slidingly received in a bore of square cross-section in the cylinder block 77. Thus the plunger is restrained against rotation about the axis of the stem portion 97. The plate 91 is pivotally mounted on aligned pins 99 for tilting movement about a horizontal axis parallel to the bars 59. The pins 99 are supported respectively in ear portions 101 of a support member 102, the ear portions being adjacent front and rear sides of the plate 91. The pad 89 is supported so that it would naturally take up a horizontal position but it can tilt to accommodate itself to lengthwise tilt of the tread face of the heel of a shoe positioned in the pad box when the pad 89 is moved into engagement with the bottom face of the heel.

The support member 102 is pivotally mounted by means of a pivot pin 103 on the stem portion 97 so as to be capable of tilting movement widthwise of the shoe (see particularly FIG. 3), and the pad 89 can accommodate itself to widthwise tilt of the shoe heel.

The pad 89 may be raised into engagement with the heel tread face by means of four piston rods, of which two piston rods have the reference number 105 in the drawings, and two piston rods have the reference number 107 and are spaced toewardly of the piston rods 105. The piston rods 105, 107 have domed upper ends for engaging the bottom of the plate 91 and are spaced so as to engage the plate 91 adjacent four corners thereof. For the sake of clarity in FIG. 1 the pad 89 and associated parts are shown elevated to a slight extent. Normally, in the rest position the plate 91 would rest on the lowered piston rods 105 and 107. The piston rods 105, 107 are constructed and arranged to raise the plate 91 together with said plunger by means of air under pressure. Piston rods 105 operate in cylinders 109 in the cylinder block 77, and pistons 111 slidably mounted in said cylinders are fixed to lower ends of the rods 105. Piston rods 107 operate in cylinders 113 in the cylinder block 77 and pistons 115 slidably mounted in said cylinders are fixed to lower ends of the rods 107. The piston rods 105, 107 are supported slidingly at upper ends of their respective cylinders. The lower ends of the cylinders 109, 113 are open to communicate with a recess 117 formed by a cut-out portion in the gasket 80. The illustrative apparatus has means for connecting the recess 117 to the factory air line and air under pressure introduced into the recess enters the cylinders 109, 113 to raise the pistons 111 and 115. There is a bleed passage 119 at the upper end of each of said cylinders to allow the escape of air above its associated piston when the piston is raised. Means is provided for controlling the maximum air pressure in the cylinders 109, 113.

Cylinders 113 are larger in diameter than the cylinders 75 and greater pressure may be exerted through the pistons 115 than the pistons 73 because of the relatively large area of some mens's shoe heels. The cylinders 109 are larger in diameter than the cylinders 113 and greater pressure may be exerted on the heelward part of the pad 89 than on its more toeward part, again because of the area to be pressed and because soles are particularly liable to separate from their shoes at the heel end if the adhesive bond is weak. The recess 117 does not communicate with the recess 79.

The tread face end of a heel of a shoe positioned in the illustrative apparatus may lie further toewardly in the case of a high heel than in the case of a lower heel. As the pad 89 is raised it is caused to move heelwardly from a toeward position in which it can engage the highest heel operated on in the apparatus to a heelward position in which it can engage the lowest heel operated on. To effect heelward movement of the pad 89 the aforementioned square section bore in which the stem portion 97 of said plunger is received extends heelwardly in the cylinder block 77 at a suitable angle from the vertical so that as the plate 91 carrying the pad 89 is raised the stem 97 guides it heelwardly. If a shoe is operated on prior to the attachment of a heel to the shoe, a pad (not shown) of suitable thickness to engage and press the heel seat portion of the shoe is placed on the plate 91 and the heelward movement of the pad as it is raised together with the aforementioned clearance 88 in the bar 85 enables the pad to engage and apply pressure to the heel seat.

Figure 2:
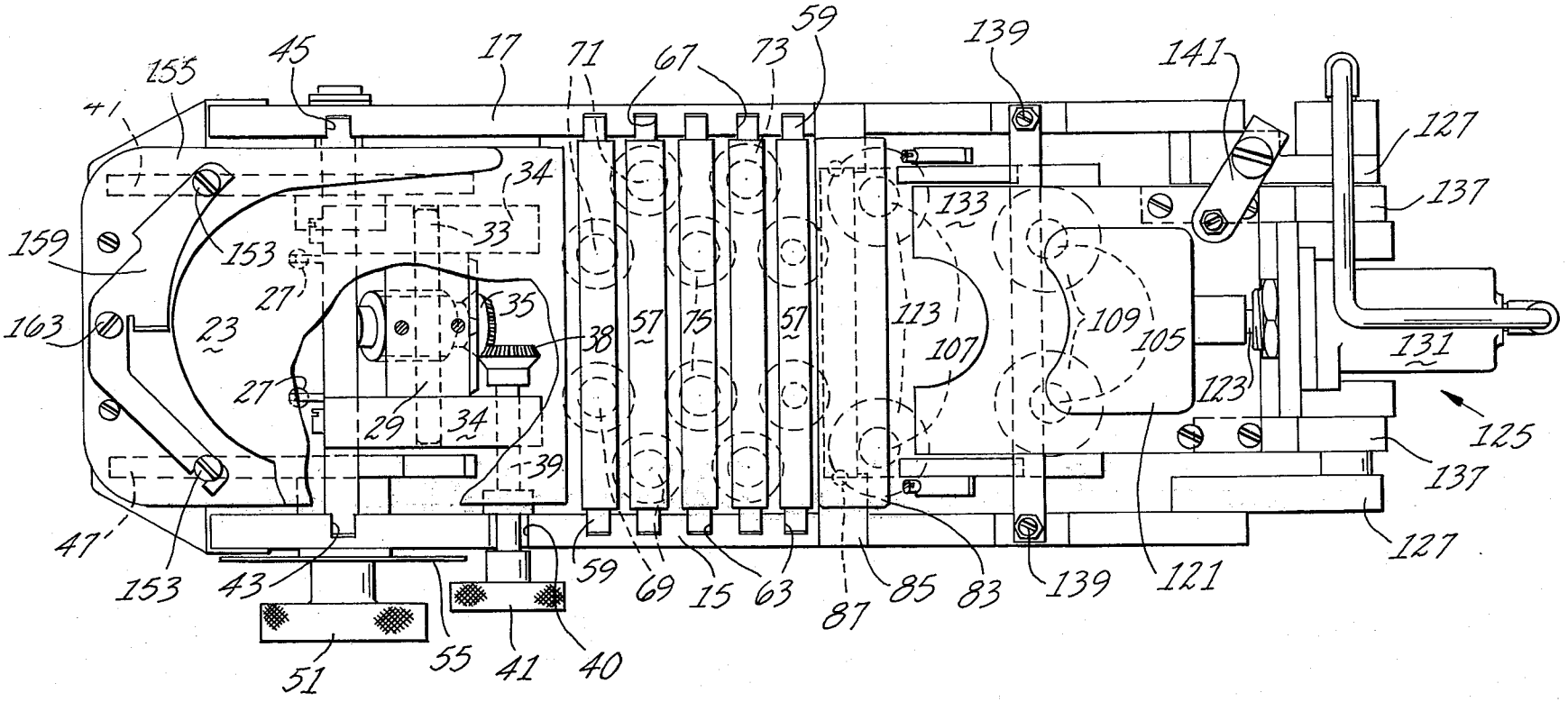
FIG. 2 is a plan view, partly broken away, of the illustrative apparatus.

The illustrative apparatus includes a heel back clamping device for supporting the heel of a Louis heel shoe which may be positioned in the pad box for operation thereon. A heel engaging pad 121 (FIGS. 1, 2) suitably shaped to engage the back of the heel is mounted on a piston rod 123 of an air operated piston cylinder device 125 pivotally supported on a shaft 129 supported in brackets 127 fixed to the walls 15 and 17 respectively. In operative position of the heel back clamping device (in which position said device is shown in FIGS. 1 and 2) air under pressure may be introduced into a cylinder 131 of the piston and cylinder device to move the piston rod 123 toewardly to engage the pad 121 in clamping engagement on the back of the heel. The pad 121 is arranged to rest on a support member 133 the pad having treads 135 (FIG. 1) which tend to grip said support member and resist heelward movement of the pad and heel held thereby when the shoe is put under sole attaching pressure. The toeward end of the support member 133 is shaped to provide a clearance for the heel of a shoe.

The support member 133 is fixed on arms 137 (FIG. 2) pivotally mounted on the shaft 129 (FIG. 1) one on each side of a mounting of said piston and cylinder device on said shaft. Adjustable screws 139 screwed into foreward and rearward extensions on a toeward portion of the member 133, in operative position of the back clamping device, support the member 133 on the side walls 15 and 17. The support member 133 is releasably held in this position by means of a catch 141, comprising a pivotal arm carrying a holddown screw, moved across a top face of the support member. On release of the catch 141 the support member may be swung through approximately 180° about the axis of the shaft 129 to an out-of-the-way position in which the heel back clamping device is supported against a tie bar 140 fixed to the walls 15 and 17. The heel engaging pad 121 and its piston and cylinder device 125 are moved to an out-of-the-way position with the support member 133 about the axis of the shaft 129. The piston and cylinder device is strapped to the arms 137 for movement therewith by means of a strap 143 and adjustable screws 145 threaded into said device. The screws 145 are adjusted so that the pad 121 does not bind on the support member 133.

In operative position of the heel back clamping device a depending actuating screw 147 (FIG. 1) in the rearmost of the arms 137 holds a valve member 149 depressed against spring resistance so that a valve 151 in an air pressure circuit may direct air under pressure from a source of pressure air to operate the piston in the cylinder 131. In this condition of the valve 151 the supply of pressure air to the recess 117 and cylinders 109 and 113 is cut off. The catch 141 resists raising of the heel back clamping device by the spring pressed valve member 149. When the heel back clamping device is moved to its out-of-the-way position, the valve member 149 is raised by its spring to cause the supply of pressure to the cylinder 131 to be cut off and open communication between the pressure air source and the recess 117. Suitably jointed and flexible pipes connect the pressure air supply with the cylinder 131 so as to permit movement of the heel back clamping device to its out-of-the-way position.

To avoid print-through on shoe soles and protect the pads 23, 57 and 83 from undue wear, a flexible apron (omitted from the drawings for the sake of clarity) is often interposed between said pads and the bottom of a shoe operated on so that the shoe bottom operated on is engaged by a smooth unbroken surface. In some cases a relatively short apron (not shown) is required, probably extending to the heel breast line of the shoe but in the case of a Louis heel shoe, for example, a longer apron is required which lies across the tops of said pads and along the breast face of the heel. The apron is positioned at its toeward end portion on studs 153 upstanding in the plate 25, the apron being retained on the studs by a generally U-shaped plate 155. The plate 155 is pivotally mounted on the plate 25 by means of a pin 157 and a catch 159 engaged under heads of the studs 153 holds the plate 155 in position against resistance of a tension spring 161 on the pin 157. Pivotal movement of the catch 159 on a pin 163 on the plate 155 releases said plate for upward pivotal movement under the influence of the tension spring. Thus the apron may be quickly removed and replaced with another appropriate to the work in hand.

In use the illustrative pad box apparatus is supported for vertical movement by a hydraulic ram (not shown) of a sole attaching press. Supposing a shoe requiring pressure to be applied to the tread face of a heel thereof is to be operated on, the heel back clamping device is moved to its out-of-the-way position. The appropriately shaped pad 83 is mounted on the bar 85, and the shoe with a sole positioned thereon and a layer of adhesive between the shoe bottom and the sole located on the pad 83 with the shoe forepart resting on the pad 23. As hereinbefore described the pad 23 may be adjusted heightwise of the shoe and tilted to accommodate the shoe bottom shape and support the shoe in the appropriate position for the distribution of sole attaching pressure.

The method of using the illustrative apparatus comprises raising the ram and apparatus bodily by means of hydraulic pressure to engage the top of a toe portion of the shoe and a heel end part of a last in the shoe with well known, suitably positioned abutments (such as A and B in FIG. 1) of the press so that the shoe is brought to rest under relatively light pressure against the abutments, then causing operation of the pistons 73, to raise the pads 57 and the pistons 111, 115 to raise the pad 89 to pressure applying positions, and increasing the hydraulic pressure to the maximum required to achieve a firm bond.

If a Louis heeled sole is being operated on, after the illustrative apparatus has been raised bodily by means of hydraulic pressure to engage the shoe and its last with said abutments, A, B so that that shoe is brought to rest against the abutments, the pistons 73 are operated to raise the pads 57 to pressure applying positions, the piston of the heel back clamping device (previously moved to its operative position) is operated to move the pad 121 to apply pressure on the back of the shoe heel and the hydraulic pressure is increased to the maximum required to achieve a firm bond. The piston of the heel back clamping device and thus the pad 121 are withdrawn by means of a spring in the cylinder 131 on release of air under pressure therein.

Having thus described out invention, what we claim as new and desire to secure by Letters Patent of the United States is:

1. Apparatus for attaching a sole to the bottom of a shoe comprising means for locating and applying pressure to the shoe and its sole thereon in the heel breast line region, supporting means for applying pressure to the forepart of the shoe and which is adjustable relatively to the locating means in a direction heightwise of the locating means and about an axis extending widthwise of the shoe, a plurality of presser members arranged between the locating means and the forepart supporting means, each of said presser members being actuatable by a fluid pressure device to apply pressure to the shoe bottom, a heel presser member mounted for movement heightwise and lengthwise of the shoe, and fluid pressure operated mechanism for thus moving the heel presser member.

2. Apparatus as in claim 1 and a fluid pressure operated back clamping device mounted for movement to an out-of-the-way position, and means for automatically disconnecting the clamping device from its source of fluid pressure when in said position and connecting said source to the fluid pressure operated mechanism associated with the heel presser member.

3. Apparatus as in claim 1 wherein a vertically reciprocable pad box holds the mentioned means and members in operative relation, a cylinder block is secured in the base of said box, and a plurality of piston-cylinder means pneumatically operable in the block some of which constitute said fluid pressure devices and the remainder of which constitute said fluid pressure operated mechanism, the cylinders associated with said heel presser member being larger in diameter than those associated with said presser members.

4. Apparatus for attaching a sole to the bottom of a shoe, comprising spaced apart fixed abutments, first means for supporting a waist portion of a shoe bottom, second means for supporting the forepart of the shoe bottom, the first means including a datum pad extending widthwise of the shoe and a plurality of waist pads movable heightwise of the datum pad by fluid pressure, the second means comprising a forepart pad and means for locating it in a selected heightwise position with a desired angle of slope lengthwise of the shoe and independently of the datum pad, the construction being such that during a shoe bottom pressing operation in cooperation with said abutments the location of the forepart pad may be selected in accordance with the shoe bottom configuration as positioned in the apparatus and the waist pads actuated to automatically support the shoe bottom in accordance with it lengthwise configuration.

5. In a sole attaching machine, a shoe bottom pad box assembly comprising first means for supporting the waist portion of a shoe bottom, second means for supporting the forepart of the shoe bottom, said first means including a datum pad extending generally widthwise of the shoe, and a plurality of waist pads movable heightwise by fluid pressure relative to the datum pad and independently tiltable widthwise of the shoe, the arrangement being such that during a shoe bottom pressing operation the waist pads are enabled to support the shoe bottom in accordance with its lengthwise configuration and may tilt widthwise to accommodate widthwise configuration of the shoe bottom.

6. In a sole attaching machine, the combination with a pad box assembly including pneumatically operable pads for supporting the heel tread face and waist portions of a shoe, of a heel back clamping device for supporting the heel of a Louis heel shoe and movable between operative and inoperative positions, said device comprising a heel engageable pad, a support for slidably resisting heelward movement of the heel pad and pivotal about an axis extending widthwise of the shoe, pneumatic means carried by said support for urging the heel pad into shoe engaging position against the influences of a spring-return means, and control means operable when the clamping device is in operative position for effectively disconnecting air pressure for operating said tread and waist pads, said control means being automatically operative when the heel clamping device is moved to its inoperative position to restore operative air pressure to the tread and waist pads and de-energize said spring-return means.

7. A method of attaching a sole to the bottom of a shoe comprising locating the shoe with a sole thereon and a layer of adhesive between the shoe bottom and the sole on a means for applying pressure to the heel breast line region and on a forepart supporting means, adjusting the forepart supporting means to tilt the shoe lengthwise thereof about the means for applying pressure to the heel breast line region to assure distribution of pressure along the shoe bottom, applying fluid pressure to cause the shoe and a last therein as thus positioned to be pressed against spaced abutments, and causing waist pressing members to engage the shoe bottom under the influence of other fluid pressure to secure the sole to the shoe bottom.

* * * * *